US006427591B1

(12) United States Patent
Schmid

(10) Patent No.: US 6,427,591 B1
(45) Date of Patent: Aug. 6, 2002

(54) INKING UNIT

(75) Inventor: Gotthard Schmid, Malsch (DE)

(73) Assignee: Heidelberger Druckmaschinen Aktiengesellschaft (DE)

( * ) Notice: Subject to any disclaimer, the term of this patent is extended or adjusted under 35 U.S.C. 154(b) by 0 days.

(21) Appl. No.: 09/470,891

(22) Filed: Dec. 22, 1999

(30) Foreign Application Priority Data

Dec. 22, 1998 (DE) ..... 198 59 437

(51) Int. Cl.[7] ..... B41F 31/00; B41J 3/00; B41J 2/01

(52) U.S. Cl. ..... 101/351.8; 347/2; 347/103; 101/365

(58) Field of Search ..... 101/351.8, 365, 101/366; 347/2, 103

(56) References Cited

U.S. PATENT DOCUMENTS 4,610,201 A * 9/1986 Jeschke ..... 101/217
4,787,313 A * 11/1988 Osborn et al. ..... 101/366
4,852,485 A * 8/1989 Brunner ..... 101/211
4,977,832 A * 12/1990 Walter ..... 101/365
5,438,923 A * 8/1995 Schoeps ..... 101/147
5,980,136 A * 11/1999 Teumer et al. ..... 400/521
6,070,525 A * 6/2000 Watanabe et al. ..... 101/129
6,101,944 A * 8/2000 Schmid et al. ..... 101/467
6,173,647 B1 * 1/2001 Kakuta et al. ..... 101/466

FOREIGN PATENT DOCUMENTS

| | | |
|---|---|---|
| DE | 1 761 715 | 4/1972 |
| DE | 35 45 535 | 7/1987 |
| DE | 42 20 177 | 12/1993 |
| DE | 43 27 212 | 2/1995 |
| DE | 197 45 136 | 4/1998 |
| DE | 197 04 003 | 8/1998 |
| EP | 0 530 627 | 3/1993 |

OTHER PUBLICATIONS

Zeitungstechnik (Newspaper Technology), Jul./Aug. 1996, p. 30 Described in specification.

* cited by examiner

*Primary Examiner*—Eugene Eickholt
(74) *Attorney, Agent, or Firm*—Kenyon & Kenyon

(57) ABSTRACT

An inking unit for a printing machine, which includes at least one ink roller rolling on a plate cylinder of the printing machine, an ink jet printing apparatus with a plurality of ink jets that can be controlled selectively, and an ink transfer device with a rotating mantle surface for transferring printing ink from the ink jet printing apparatus to the at least one ink roller. A compact and stencil-free inking unit for high-quality printing is achieved and the at least one ink roller and the ink transfer device, and have the same outside circumference as the plate cylinder.

12 Claims, 2 Drawing Sheets

INKING UNIT

The invention relates to an inking unit for a printing machine, which includes at least one ink roller rolling on a plate cylinder of the printing machine, an ink jet printing apparatus with a plurality of ink jets that can be controlled selectively, and an ink transfer device with a rotating mantle surface for transferring printing ink from the ink jet printing apparatus to the at least one ink roller.

DESCRIPTION OF RELATED ART

Inking units with an ink duct as a supply container for printing ink, an ink doctor roller, an ink lifter, and an arrangement of many ink rollers that roll on one another and/or on the plate cylinder of the printing machine, including ink transfer rollers, brayer rollers, and ink application rollers, are frequently used in offset printing machines. The amount of printing ink needed is set by zones, as a function of the print image shape. A resilient blade (doctor blade) is pressed against the doctor roller to a greater or lesser degree, and therefore the amount of ink which passes through the gap between the doctor blade and the doctor roller is changed. Regulation of the amount of printing ink over the entire width of the doctor roller is done by a change in the ink take-off strip, which is taken from the doctor roller by the ink lifter, in a rhythmic pendulum motion. The printing ink is distributed, split up, and spread out by an axial movement of the brayer rollers, by means of the subsequent arrangement of hard and soft rollers with different diameters, before it is applied to the plate cylinder by means of the ink application rollers.

Such inking units that are divided into ink zones over the width of the print, have a number of electronic or electro mechanical control and setting elements for the doctor blades and other devices, with which the machine operator can vary the feed of ink in accordance with the subject of the print, over the width of the print. The number of ink zones is based on the size of the setting elements used, the justifiable effort and expense, and the width of the print form. With an increasing number of narrow ink zones, the number of display elements that can be printed increases, but the working time and the number of discard sheets also increases, especially if a manual color correction takes place during printing by widening or reducing the ink zone size. The ink zone size, together with the doctor roller stroke, determines the ink zone width that is necessary at the specific location of the sheet.

One problem with such inking units is so-called stenciling, a shadow-like image of a previous part of the printed image, which repeats in the printing direction. This image shows up as a greater or lesser coloration in comparison with the surrounding area. The intensity of stenciling can be reduced by brayer rollers that distribute the ink along the width of the print, and/or by ink application rollers, among other things. In every case, however, a large number of rollers is required in the inking unit, in order to guarantee the most uniform possible thickness of the ink layer on the ink application rollers, and finally on the plate cylinder, by using as many division locations as possible. In spite of this, there are many inadequacies that remain, caused by the width and number of ink zones, such as degraded print in the border zones, excess ink feed or insufficient ink feed.

As an alternative to the inking units with many rollers that have been described, inking units with a short construction length, such as anilox inking units are known, which have so-called chamber doctor blade ink ducts. However, ink feed by zones is not possible with a chamber doctor blade ink duct. The depth and the number of depressions on the raster roller and the amount of ink taken off per sheet determines the amount of ink supplied per revolution of a single revolution plate cylinder.

German Patent Application 43 27 212 A1 describes an inking unit in which metered ink application onto the mantle surface of an ink roller takes place according to the ink jet principle. The ink application process is controlled using digital data derived from data for production of the print form. The ink jets of the ink jet apparatus are either directed onto an ink application roller which rolls on the plate cylinder of the printing machine, or onto an ink roller that passes the ink directly to the ink application roller.

In principle, this system results in an inking unit with a short construction length, with ink application that can be precisely metered both in the width direction of the roller in accordance with ink regulation by zones, as in inking units with zones, and also in its circumferential direction. A disadvantage of this system is that since braying does not take place, a high level of stenciling occurs. This can only be counteracted if the ink is transferred from one roller to another leaving as little residue as possible, so that the resolution of the ink jet printing apparatus is as high as possible. Ideally, the resolution of the ink jet printing apparatus should be as high as the required print quality. This calls for a type of indirect ink jet printing, which means that the advantages of offset printing, namely inexpensive printing of high-quality editions, no longer exist.

SUMMARY OF THE INVENTION

The invention is an inking unit for high-quality printing, that has a short construction length and is free of stenciling.

In one embodiment, the invention is an inking unit for a printing machine, that includes at least one ink roller rolling on a plate cylinder of the printing machine, an ink jet printing apparatus with a plurality of ink jets that are selectively controllable, and an ink transfer device with a rotating mantle surface for transferring printing ink from the ink jet printing apparatus to the at least one ink roller, wherein the at least one ink roller and the ink transfer device have an outside circumference substantially equal to an outside circumference of the plate cylinder.

The inking unit in accordance with the invention has at least one ink roller and an ink transfer device, which is an ink transfer roller, that have the same outside circumference as the plate cylinder, and that are all single revolution rollers. In this manner, the amount of ink which belongs to a certain image region of the subject of the print, and which is precisely metered, is always applied at the same location on the ink transfer device and all the other rollers, from which it is also passed on to the sheet. This makes it possible to reliably avoid the effect of stenciling, which occurs in known short inking units because of insufficient braying.

Another embodiment includes ink application onto the at least one ink roller in such a way that the most uniform ink application possible, viewed in the circumferential direction, takes place. By adjusting the ink jet printing apparatus to the contour of the at least one ink roller, several ink jets can be arranged one behind the other, viewed in the circumferential direction. This makes it possible to apply many small dots of ink onto the ink roller, corresponding to a film-like coating. This makes it unnecessary to have the high degree of braying that is required when lifting an ink strip using an ink lifter. In addition, an ink zone which is normally 32 mm wide can be defined to be much narrower, because of the high resolution which can be produced using an ink jet apparatus. This also makes better metering possible, although ink distribution is not adapted to the subject of the print in the circumferential direction.

In comparison with a conventional inking unit with a doctor roller and a lifter, the invention also results in elimination of many mechanical parts, so that the machine runs more quietly.

Quieter operation of the machine results not only from the elimination of side-to-side braying, as mentioned above, but also from the more uniform application of ink in the circumferential direction. This means that in conventional inking units, particularly in short inking units, a temporary tightness of the ink rollers occurs when the lifter suddenly applies the ink. This tightness is eliminated once the volume of ink is distributed. However, since this process recurs cyclically, it is a source of vibrations. The device according to the invention makes it possible to keep the required roller torque constant, because the printing ink is applied in a uniform thickness over the circumference of the ink roller.

The invention is particularly well suited for offset printing machines using so-called computer-to-press direct imaging technology, used in the Heidelberger Druckmaschinen AG Quickmaster-DI, and in which the imaging unit is moved into the printing machine. The plates are imaged on the cylinder directly in the printing machine, in that the untreated print form or printing plate is affixed to a plate cylinder and imaged by an imaging head installed in the printing machine. this produces a print form that can be used for offset printing. The raster data, which is already available at the printing machine, can be additionally used in printing operation to control the ink jet printing apparatus during every machine cycle, without having to recreate the data. An adjustment of the resolution of the raster data to the resolution of an ink jet apparatus, which is normally lower, can be carried out in a very simple manner. For example, the reduction in resolution can easily be carried out in the printing machine computer.

While the resolution of the ink jet printing apparatus is preferably designed to be less than the resolution of the raster data for the imaging unit, when the invention is used for an offset printing machine, the corresponding resolution values can be the same for printing methods other than offset printing, such as anilox printing, rotogravure, or other printing methods, for which the invention is also suitable. The image raster data from the stage before printing can also be used additionally for the ink jet printing apparatus, when using such printing method.

The invention is not only suitable for printing methods that use a master, in which the printing plate such as the image carrier is produced only once per print job, but also for future digital printing machines using so-called computer to paper technology, in which either the same or new image data are read out once, in their entirety for imaging each individual print substrate. In both cases, the ink jet printing apparatus also calls up the entire data once per cylinder revolution. The computer used on the printing machine must have sufficient power to make these high data rates available within the required period of time. In order to guarantee availability of the data, suitable data memory systems are used in the stage before printing.

The inking unit according to the invention can be installed in place of a conventional inking unit also in conventional printing machines, without a built-in plate imaging unit, since suitable digital data are already available for the ink jet printing apparatus from the plate exposure unit (CTP) or from the film exposure unit (CTF). These merely have to be transferred to the printing machine, if necessary, after an adjustment of the resolution.

The ink jets of the ink jet printing apparatus can be arranged, for example, simply distributed in a single straight line over the width of the print, close to the ink transfer device. Preferably, however, a two-dimensional arrangement or matrix of ink jets is used. If the ink transfer device is an ink transfer roller, the matrix of ink jets must be curved, in order to rest closely against the mantle surface of the ink transfer roller.

In a further development of the invention, an endless belt which runs around two or more rollers is used as the ink transfer device. This has the advantage that the ink jet matrix can be flat, since it can be arranged at a straight segment of the ink transfer belt.

To limit the extent of braying, at least one of the ink rollers and/or the ink transfer device can be provided with a known drive for a slight back and forth movement along its axis during printing operation, so it can oscillate or change position. However, the amplitude of this movement should not be significantly greater than the resolution of the ink jet printing apparatus, so that subject-specific metering is not defeated.

In accordance with a further development of the invention, an ink doctor blade that can be optionally activated is provided on at least one of the ink rollers and/or the ink transfer device. Since an active feed of ink takes place with the ink jet printing apparatus, and there is no limited ink feed-back as in the case of ink duct systems, excess inking and excess filling of the inking unit can occur. In the case of conventional ink duct systems, this can be avoided or reduced by the fact that the residual ink film thickness on the lifter prevents the same amount of ink from always coming in at the same time, independent of the layer thickness. The ink doctor blade of the invention can be activated at selected points in time in order to create a neutral starting position in the inking unit. This can take place during a short interruption of printing that takes place automatically during color printing, and/or before and after every printing job. A control unit with adjustable parameters makes it possible for the printer to adjust the "neutralization intervals", in accordance with the printing job, based on experience. The ink doctor blade can be divided into several individual doctor blades over the width of the print, which can even be activated independent of one another, allowing local scraping. In addition, the ink doctor blade can be used in known manner to scrape off the ink in case of a color change or if the inking unit has become dirty.

As an alternative to an ink doctor blade, or in addition to it, one or several sensors can be provided, which detect the amount of ink residue and are included in a control circuit for automatic regulation of spraying with fresh ink.

In the case of a color change, the ink jet printing apparatus can simply be replaced. A particularly rapid color change is made possible by having two or more ink jet printing apparatuses arranged next to one another, so as to pivot. The printing apparatus which is needed in each instance is pivoted into a position in which the ink jets are directed at the ink transfer device.

The inking unit according to the present invention requires only few ink rollers between the ink transfer device and the plate cylinder, and can therefore be structured in very compact manner. In many cases, a single ink roller between these two elements is sufficient.

Conventional equipment with which a machine operator can readjust the feed of ink by zones, if necessary, contain a large number of control and display elements which are correspondingly difficult to activate and monitor. In a further development of the invention, which results in a good ergonomic layout of controls for the operator, a control device for zone-free readjustment of the ink feed is provided, which contains a screen to display the current print subject, where any fields of the print subject being displayed can be selected by the operator. Preferably this can be done in a manner known from layouts used in programs for image processing, by using a mouse or other input device.

The inking unit according to the present invention is suitable both for water-free offset printing and for wet offset printing. However, printing inks with low viscosity are required if a print head for conventional ink jet printers is used as the ink jet printing apparatus. Such a print head operates in such a manner, for example, that a small volume of printing ink is briefly compressed by a piezoelectric actuator, causing a droplet of printing ink to be sprayed onto a pixel.

If the ink jet printing apparatus is designed suitably, however, an inking unit according to the invention can also handle standard offset printing inks with relatively high viscosity, or offset inks that are dried under UV light. For this purpose, a high-pressure pump device to supply the ink jet printing apparatus with printing ink at a predetermined high pressure, a heating device to heat the printing ink to a predetermined temperature above room temperature, and a plurality of valves for selective control of the ink feed to the ink jets of the ink jet printing device are provided.

Because the printing ink, which normally has a viscosity of approximately 50 to 70 Pa s, is transported to the valves at a pressure in the range of approximately 10 to 100 bar, and is heated to a temperature in the range of approximately 40 to 70° C. during this process, the viscosity is reduced to such an extent that ink metering with high precision is possible.

The valves can be pulse length controlled solenoid valves, for example, as described in the journal Zeitungstechnik [Newspaper Technology], July/August 1996, p. 30, for an inking unit in which the printing ink is applied to a specially designed ink film roller, using a digital ink pump system that includes a gear pump.

In a more preferred embodiment, valves with piezoelectric actuators, so-called piezo valves, can be used as the adjustment elements. Such a valve, as described in German Patent A-4 220 177, for example, has reaction times on the order of microseconds. Therefore it can be opened and closed many times faster than conventional solenoid valves, which have reaction times of several milliseconds. This results in very precise metering of the printing ink, preferably by means of pulse length controlled complete opening and closing of the valve, or, alternatively, by regulation of the flow-through amount of a valve, whose degree of opening is controlled by a fast control circuit. In addition, fast piezo valves can be used to achieve a relatively high printing resolution of the ink jet printing apparatus, even at very high printing speeds. Such a high printing resolution would be restricted by long valve reaction times.

BRIEF DESCRIPTION OF THE DRAWINGS

The invention will be explained in greater detail below, on the basis of exemplary embodiments, with reference being made to the drawings.

In the drawings.

DETAILED DESCRIPTION OF PREFERRED EMBODIMENTS OF THE INVENTION

Figure 1:
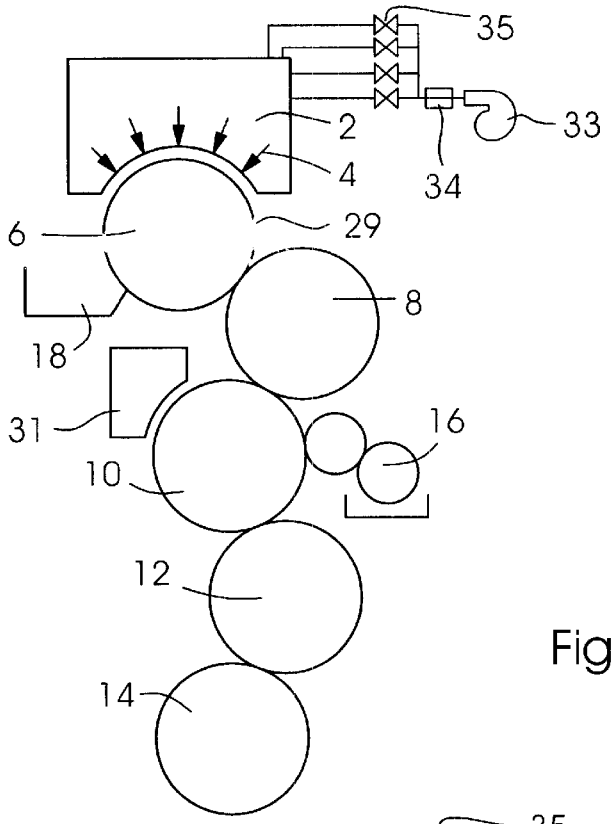
FIG. 1 shows a diagram of an inking unit for an offset printing machine, which contains an ink jet printing apparatus.

The inking unit shown in FIG. 1 contains an ink jet printing apparatus 2 with a plurality of ink jets 4, which are drawn schematically as arrows, indicating the ink spraying direction. Ink jets 4 are arranged in a two-dimensional matrix which rests against an ink transfer roller 6, forming a slight gap in between. A high-pressure pump device 33 may be provided to supply the ink jet printing apparatus with printing ink at a predetermined high pressure. A heating device 34 to heat the printing ink to a predetermined temperature above room temperature may be provided,and a plurality of valves 35 for selective control of ink feed to the ink jets of the ink jet printing device may be provided.

Ink transfer roller 6 has a rotating mantle surface 29 and rolls on an ink application roller 8, which in turn rolls on a plate cylinder 10 of an offset printing machine. A plate imaging unit 31 is located adjacent to the plate cylinder 10. A blanket cylinder 12 and a printing cylinder 14 are also shown in FIG. 1. All of these rollers and cylinders are single-revolution types, i.e. they have the same diameter.

In addition, a fountain 16 for wet offset printing is drawn schematically in FIG. 1. In the case of waterless offset printing, fountain 16 is not used.

An ink doctor blade 18 can be arranged adjacent to ink transfer roller 6, and can be pivoted against ink transfer roller 6 and away from it.

In operation, ink jets 4 are selectively turned on and off in accordance with raster data that are supplied to ink jet printing apparatus 2, in order to spray printing ink onto ink transfer roller 6 in accordance with the raster data. The exact amount of ink required on plate cylinder 10 is supplied to every point on transfer roller 6.

To achieve this, the raster data which represent the print image and are supplied to a plate exposure unit, not shown in the drawing, are converted to a raster image corresponding to the matrix of ink jets 4, and ink jet printing apparatus 2 is controlled with this data. Ink jets 4 supply precisely the amount of ink that is passed over from plate cylinder 10 to the paper or other print substrate during the printing process, at every location of ink transfer roller 6. The division locations between ink transfer roller 6 and ink application roller 8, and between ink application roller 8 and plate cylinder 10, ensures a smooth film of ink, so that the resolution of ink jet printing apparatus 2 becomes so high that it is invisible to the eye.

A raster image suitable for ink jet printing apparatus 2 normally has a much lower resolution than the normal offset resolution, since the distance between ink jets 4 is relatively large. This does not reduce the quality of the print according to the invention, since the resolution is determined by plate cylinder 10, but rather improves it since stenciling is prevented in a reliable manner.

In the case of a coarse subject, or in regions of a subject with little variation, several ink jets 4 can be controlled jointly. In the case of detailed representations, ink jets 4 are controlled individually, while in the case of coarse or large-area representations, ink jets 4 are controlled jointly.

To regulate the total amount of ink applied to ink transfer roller 6 sensors can be provided to detect the amount of ink remaining on ink application roller 8. Alternatively, the work can be carried out with a slight excess of ink, with a neutral situation being produced from time to time, using the ink doctor blade.

Figure 1A:
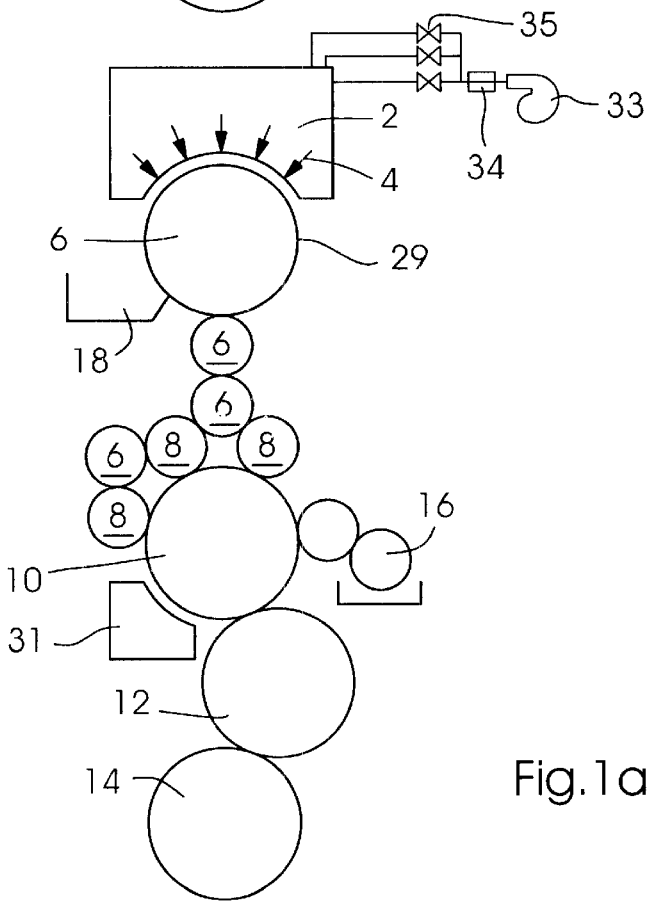
FIG. 1*a* shows a diagram of a conventional inking unit, which contains an ink jet printing apparatus.

FIG. 1*a* shows an ink roller arrangement used in conventional inking units, where an ink jet printing apparatus 2 with a plurality of ink jets is provided. Similarly to the system in FIG. 1, ink jets 4 of FIG. 1*a* are arranged in a two-dimensional matrix. The two-dimensional arrangement of ink jets 4 brings about the advantage that an almost film-like application of ink to an ink transfer roller 6 can be applied with many small dots of ink. This makes braying unnecessary. Braying is required for conventional inking units because an ink strip applied to an ink roller by the ink lifter must be made uniform in the circumferential direction. This is an advantage, particularly in the case of small offset printing machines, since vibrations caused by sideways braying have a particularly negative effect on the print quality. The number of ink transfer rollers 6 can thereby be reduced to a minimum.

Figure 2:
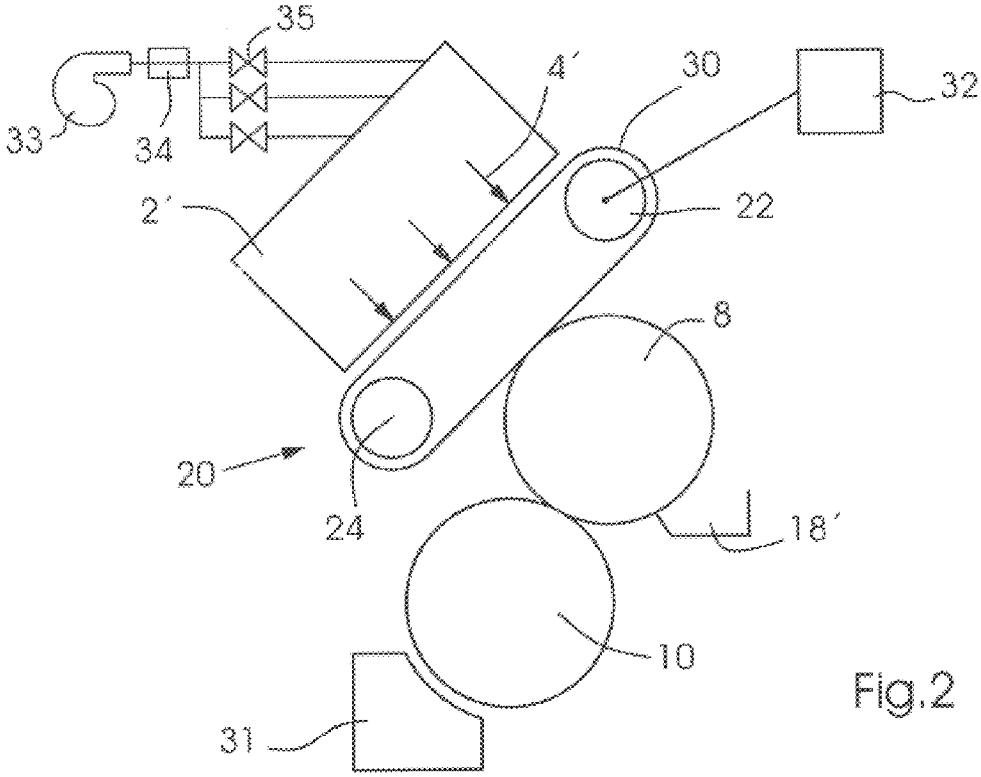
FIG. 2 shows a diagram of a partial view of an alternative embodiment of the inking unit.

FIG. 2 shows a partial view of an inking unit that has a similar structure as the inking unit of FIG. 1. The inking unit in FIG. 2 differs from the one in FIG. 1 in that a different ink transfer device is used. In FIG. 1, the ink transfer device is an ink transfer belt 20 with a rotating mantle surface 30, for example made of steel or rubber, which runs around two rollers 22, 24, instead of ink transfer roller 6. Ink transfer belt 20 has the same circumference as plate cylinder 10. Ink jet printing apparatus 2' is arranged on a straight segment of ink transfer belt 20. Ink jets 4' are arranged in a plane, making it easier to produce ink jet printing apparatus 2'.

If desired, ink transfer belt 20, can move back and forth slightly in the direction of the printing width shown in FIG. 1, similarly to the ink transfer roller 6. A drive 32 is provided to move the ink transfer belt back and forth. This can be done to assure slight braying. In the exemplary embodiment of FIG. 2, an ink doctor blade 18', similar to ink doctor blade 18 in FIG. 1, is arranged not on the ink transfer device, belt 20, but rather on ink application roller 8.

As with a conventional offset printing machine with ink zones, the inking units in FIGS. 1 or 2 can have a feed of ink that is influenced by the machine operator, along the printing width. For this purpose, no additional mechanical or electromechanical control and adjustment elements are required. Rather, this influence can be exerted purely with program control, specifically in any regions that are selected as desired, and not just within specific zones. In addition, the influence on the feed of ink can be exerted not just along the width of the sheet, but also in the circumferential direction, along the length of the sheet.

The inking units shown in FIGS. 1 and 2 make it possible to influence the feed of ink at selected locations, without incurring the risk of stenciling, since the single-revolution design of the rollers and of the belt causes the conveying of more or less ink, at a specified location, such as the takeoff location, and nowhere else.

It is also possible to control ink jet printing apparatus 2, 2' in such a way, that ink application takes place with a corresponding phase offset, so that because of the take-up, the ink is applied at the location of plate cylinder 10 provided for that purpose. This can be done in the case of an ink transfer roller 6 or an ink transfer belt 20 that has not been designed for single-revolution operation.

It is advantageous if application of ink from ink jet printing apparatus 2, 2' takes place on an ink transfer roller 6 and then directly onto plate cylinder 10. It can furthermore be advantageous to scrape ink transfer roller 6 behind the contact location with plate cylinder 10. However, it is also possible that 100% ink transfer onto plate cylinder 10 takes place by means of corresponding surfaces on ink transfer roller 6.

Figure 3:
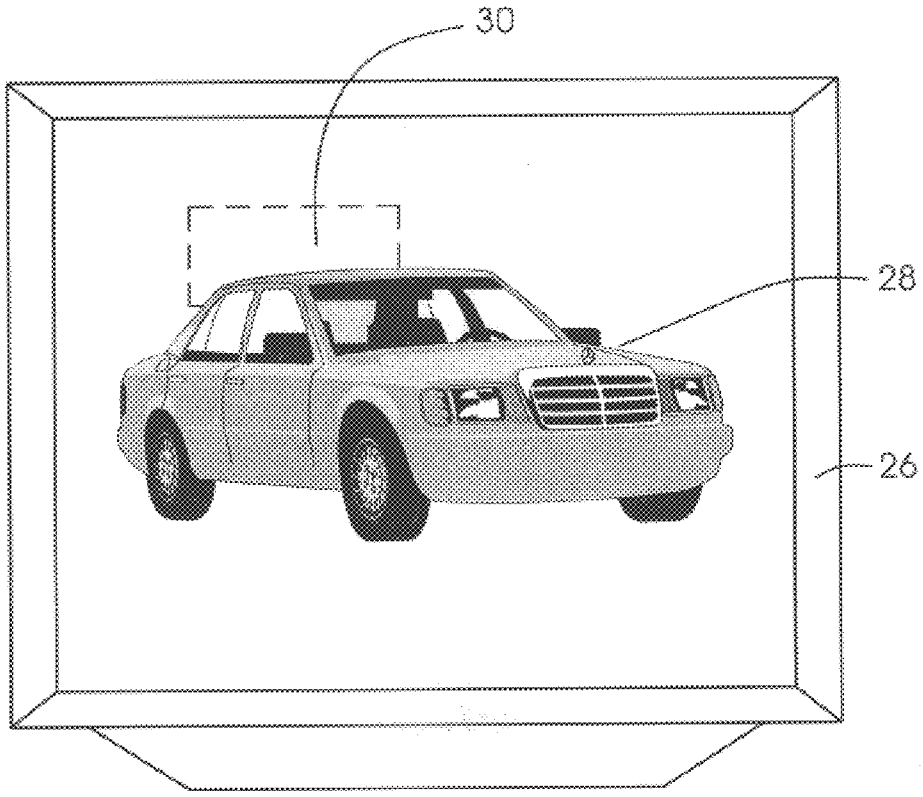
FIG. 3 shows a computer screen to display a print subject, used in providing commands to the ink feed in selected regions to be printed.

A particularly practical way of achieving zone-free ink regulation both in the width direction and in the circumferential direction is illustrated in FIG. 3, which shows a computer screen 26 on which a subject 28 that has just been printed is displayed. For example, computer screen 26 can display the raster image of subject 28 that was used for the plate exposure unit.

If the machine operator realizes, on the basis of a fresh copy of the print, that a readjustment of the ink feed is necessary for example in a region of subject 28 that has been marked with broken lines, the operator can draw a corresponding field 30 on computer screen 28, using the mouse or another pointing device. Dragging with the mouse at a corner or an edge of field 30, shown with broken lines, makes the field larger or smaller, as is known from image processing applications.

After the operator has established the exact size and position of field 30, he/she can select it by a suitable action, such as double-clicking with the mouse. Then, a window for ink regulation can open in which the desired correction can be specified in terms of intensity and direction. The operator can easily and simply correct the ink feed in any desired regions of subject 28 in this or a similar way.

The method for color correction illustrated in FIG. 3 is only an example and can be modified in many different ways. For example, a touch-sensitive or proximity-sensitive screen can be used, on which the printer can make the necessary corrections without having to touch any additional operating elements.

What is claimed is:

1. An inking unit for a printing machine, comprising:

at least one ink application roller rolling on a plate cylinder of the printing machine;

an ink jet printing apparatus with a plurality of ink jets that are selectively controllable; and an ink transfer device with a rotating mantle surface for transferring printing ink from the ink jet printing apparatus to the at least one ink roller, wherein the at least one ink roller and the ink transfer device have an outside circumference substantially equal to an outside circumference of the plate cylinder;

wherein at least one of the plurality of ink jets is arranged behind another one of the plurality of ink jets.

2. The inking unit according to claim 1, wherein the printing machine is an offset printing machine, and a raster distance between the ink jets is less than an image resolution of the offset printing machine.

3. The inking unit according to claim 2, further comprising a plate imaging unit, and wherein raster data used for the plate imaging unit before printing operation is also used during repeated cycles of printing operation to control the ink jet printing apparatus.

4. The inking unit according to claim 1, wherein the ink transfer device is an ink transfer roller.

5. The inking unit according to claim 1, wherein the ink transfer device is an ink transfer belt, and wherein the plurality of ink jets is disposed in a plane substantially parallel to a straight-line segment of the ink transfer belt.

6. The inking unit according to claim 1, wherein at least one of the ink rollers and the ink transfer device comprises a drive adapted for back and forth movement along a roller axis during printing operation.

7. The inking unit according to claim 1, further comprising an ink doctor blade provided on at least one of the ink rollers and the ink transfer device, wherein the ink doctor blade is selectively engageable.

8. The inking unit according to claim 1, further comprising one ink roller disposed between the ink transfer device and the plate cylinder.

9. The inking unit according to claim 1, further comprising:

a control device allowing an operator to control ink feed; and a screen of the control device for displaying a current print subject, wherein the operator can select fields of the current print subject to be controlled.

10. The inking unit according to claim 1, wherein the ink jet printing apparatus comprises:

a high-pressure pump device to supply the ink jet printing apparatus with printing ink at a predetermined high pressure;

a heating device to heat the printing ink to a predetermined temperature above room temperature; and a plurality of valves for selective control of ink feed to the ink jets of the ink jet printing device.

11. The inking unit according to claim 1, wherein the plurality of valves includes piezoelectrically activated valves.

12. An inking unit for a printing machine, comprising:

at least one ink application roller rolling on a plate cylinder of the printing machine;

an ink jet printing apparatus with a plurality of ink jets that are selectively controllable;

an ink transfer device with a rotating mantle surface for transferring printing ink from the ink jet printing apparatus to the at least one ink roller, wherein the at least one ink roller and the ink transfer device have an outside circumference substantially equal to an outside circumference of the plate cylinder, and wherein the printing machine is an offset printing machine, and a raster distance between the ink jets is less than an image resolution of the offset printing machine;

a plate imaging unit, wherein raster data used for the plate imaging unit before printing operation is also used during repeated cycles of printing operation to control the ink jet printing apparatus; and a device to reduce image resolution, adapted to use the raster data to produce corresponding degraded raster data with a lesser image resolution to control the ink jet printing apparatus.

* * * * *